US009810006B2

(12) United States Patent
Papanikolaou et al.

(10) Patent No.: US 9,810,006 B2
(45) Date of Patent: Nov. 7, 2017

(54) LOW EFFORT OUTSIDE RELEASE HANDLE

(71) Applicant: Ford Global Technologies, LLC, Dearborn, MI (US)

(72) Inventors: Kosta Papanikolaou, Huntington Woods, MI (US); Livianu Dorin Puscas, Rochester Hills, MI (US); Rajesh K. Patel, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 231 days.

(21) Appl. No.: 14/295,834

(22) Filed: Jun. 4, 2014

(65) Prior Publication Data

US 2015/0354253 A1 Dec. 10, 2015

(51) Int. Cl.

| | |
|---|---|
| ***E05B 3/00*** | (2006.01) |
| ***E05B 85/14*** | (2014.01) |
| ***E05B 79/20*** | (2014.01) |
| ***E05B 85/16*** | (2014.01) |
| *E05B 7/00* | (2006.01) |
| *E05B 85/10* | (2014.01) |

(52) U.S. Cl.
CPC ..... *E05B 85/14* (2013.01); *E05B 79/20* (2013.01); *E05B 85/16* (2013.01); *E05B 85/10* (2013.01); *Y10T 292/57* (2015.04)

(58) Field of Classification Search
CPC ..... E05B 85/10; E05B 85/14
USPC ..... 292/336.3
See application file for complete search history.

(56) References Cited

U.S. PATENT DOCUMENTS

| | | | | |
|---|---|---|---|---|
| 1,804,382 | A | 5/1931 | Kashian | |
| 2,355,449 | A * | 8/1944 | Lakin | C23C 2/38 292/165 |
| 3,113,798 | A * | 12/1963 | Kramer | E05B 1/0038 292/336.3 |
| 4,475,754 | A * | 10/1984 | Arlauskas | E05B 85/16 292/336.3 |
| 4,482,179 | A * | 11/1984 | Johnson | E05B 1/0038 292/336.3 |
| 4,907,833 | A * | 3/1990 | Ogasawara | E05B 85/18 292/336.3 |
| 5,039,145 | A | 8/1991 | Frye | |
| 6,264,257 | B1 * | 7/2001 | Meinke | E05B 85/10 292/336.3 |
| 6,363,577 | B1 * | 4/2002 | Spitzley | E05B 79/06 16/438 |
| 8,038,185 | B2 * | 10/2011 | Wood | E05B 77/06 292/336.3 |
| 8,322,077 | B2 * | 12/2012 | Papanikolaou | 292/336.3 |

(Continued)

FOREIGN PATENT DOCUMENTS

| | | |
|---|---|---|
| GB | 935660 | 9/1963 |

*Primary Examiner* — Carlos Lugo
(74) *Attorney, Agent, or Firm* — Jason Rogers; Price Heneveld LLP

(57) ABSTRACT

A vehicle door includes a handle having an angled or inclined ramp surface. A bellcrank is rotatably connected to the door structure for rotation about a generally horizontal axis. The bellcrank includes a follower that engages the inclined ramp surface such that movement of the exterior handle from the rest position to the opened position causes the bellcrank to rotate and shift linkage that unlatches a the latch mechanism.

16 Claims, 5 Drawing Sheets

(56) References Cited

U.S. PATENT DOCUMENTS

| | | | | |
|---|---|---|---|---|
| 2013/0187394 | A1* | 7/2013 | Lesueur | E05B 77/06 292/336.3 |
| 2014/0292005 | A1* | 10/2014 | Bendel | E05B 77/06 292/336.3 |
| 2015/0345188 | A1* | 12/2015 | Puscas | E05B 85/14 292/336.3 |

* cited by examiner

LOW EFFORT OUTSIDE RELEASE HANDLE

FIELD OF THE INVENTION

The present invention generally relates to handles for vehicle doors, and particularly, to an outside door handle that requires very low user effort to unlatch the vehicle door.

BACKGROUND OF THE INVENTION

Various types of vehicle doors, latches, and handles have been developed. Known exterior door handles may be mechanically interconnected to a door latch by linkage and/or cables. One known arrangement includes an inertia counterweight, bellcrank lever and related components. However, known door handles and linkages may suffer from various drawbacks.

SUMMARY OF THE INVENTION

One aspect of the present invention is a vehicle door including a door structure having inner and outer sides. An exterior handle is movably mounted to the door structure for movement between a rest position and an open position. The exterior handle includes an inclined or angled ramp surface. The vehicle door also includes a movable member such as a bellcrank that is movably/rotatably connected to the door structure for rotation about a generally horizontal axis. The bellcrank includes a follower that engages the inclined ramp surface such that movement of the exterior handle from the rest position to the opened position causes the bellcrank to rotate. The vehicle door also includes a latch mechanism that is configured to selectively retain the door in a closed position when latched. A linkage operably interconnects the bellcrank and the latch mechanism such that rotation of the bellcrank unlatches the latch mechanism.

Another aspect of the present invention is a vehicle door including a door structure and a latch mechanism. A handle including an outwardly facing ramp surface is pivotably connected to the door structure. The vehicle door also includes a bellcrank and a cable interconnecting the latch mechanism and the bellcrank. The bellcrank slidably engages the ramp surface and rotates about a horizontal axis and pulls the cable to unlatch the latch mechanism as the handle pivots open.

Another aspect of the present invention is a handle assembly for vehicle doors. The handle assembly includes a handle member having a forward end that is configured to be pivotably connected to a vehicle door for rotation about a generally vertical axis. The handle member has a rearward end including an extension defining a ramp surface. The handle assembly also includes a bellcrank having a follower surface configured to slidably engage the ramp surface and rotate the bellcrank about a generally horizontal axis as the handle is moved from a closed position to an open position.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
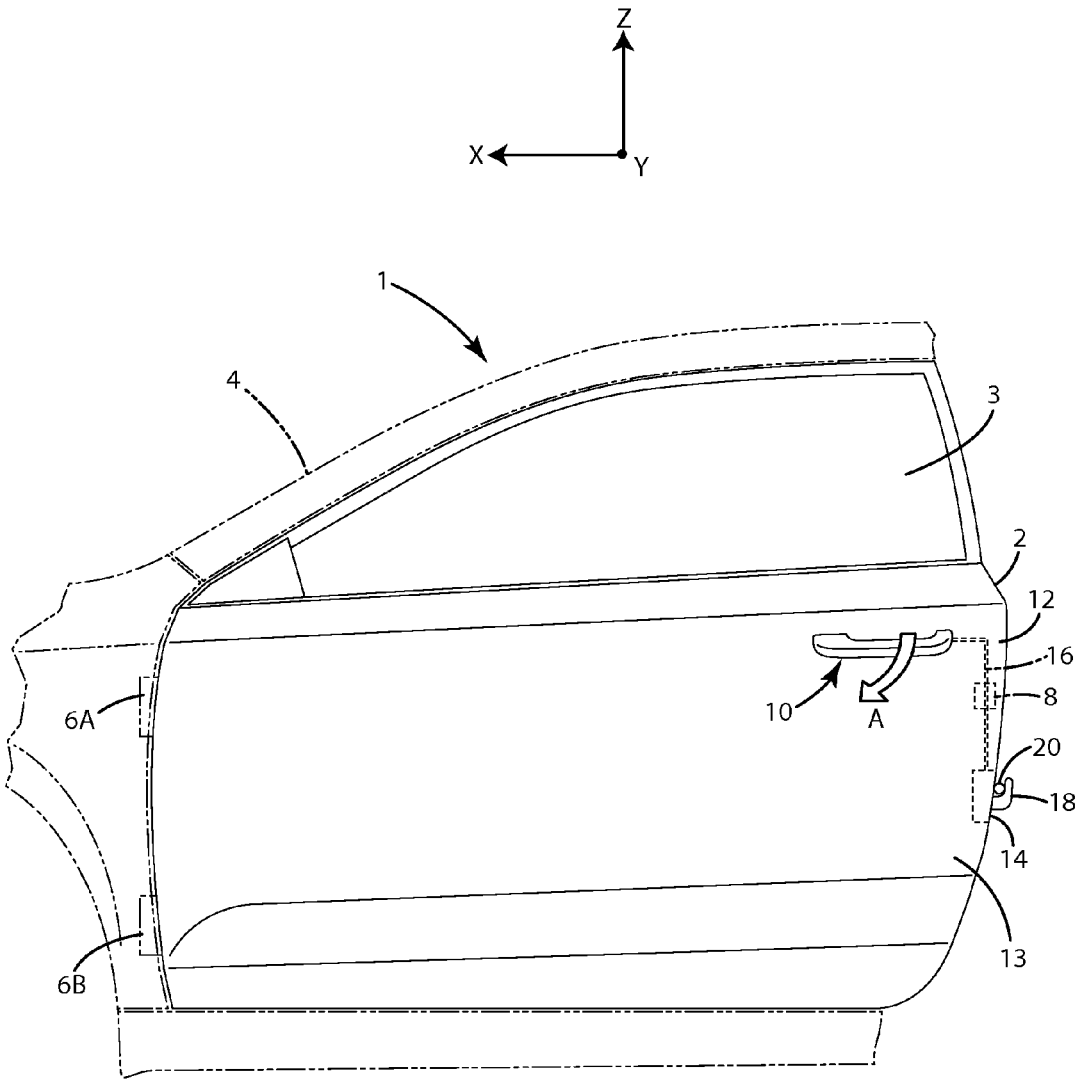
FIG. 1 is a plan view of a vehicle door according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
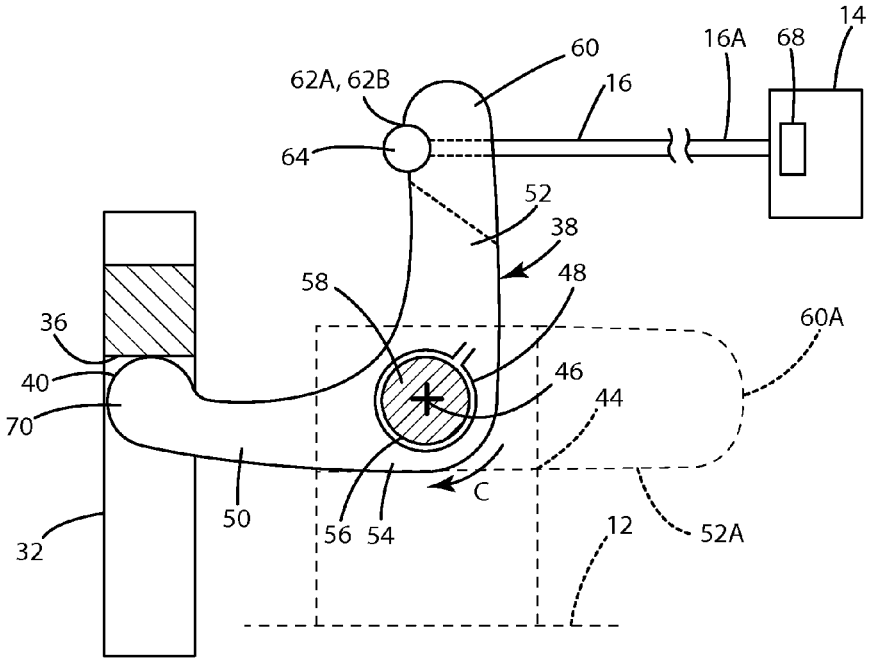
FIG. 3 is a cross sectional view of a portion of the door handle of FIG. 3 taken along the line III-III.

With reference to FIG. 1, a vehicle 1 generally defines a fore-aft axis X, a horizontal (outward) axis Y, and vertical axis Z. Vehicle 1 includes a door 2 that is movably mounted to vehicle structure 4 by hinges 6A and 6B in a known manner for rotation about a vertical axis. Door 2 includes movable glass 3, an outer skin 13, and an exterior door handle 10 that is movably mounted to door structure 12 for outward rotation as shown by the arrow "A." Handle 10 is operably connected to a latch mechanism 14 by linkage such as a cable 16. As discussed in more detail below, a speed-based cable lock mechanism 8 is operably connected to cable 16 to prevent unlatching of latch mechanism 14 in the event of a side impact. Latch mechanism 14 may comprise a conventional latch mechanism including a claw that releasably engages a striker 20 to selectively retain the door 2 in a closed position. The latch mechanism 14 may include a pawl (now shown) that selectively retains the catch or claw 18 in a latched configuration. The cable or linkage 16 is operably connected to the pawl to thereby shift the pawl and unlatch the latch mechanism 14. An example of a latch mechanism of this type is shown in FIG. 3 of U.S. Pat. No. 8,544,901, the entire contents of which are incorporated by reference. The structure and functions of this type of latch mechanism are well known to those skilled in the art, and a detailed description of the latch mechanism 14 is therefore not believed to be required.

Figure 2:
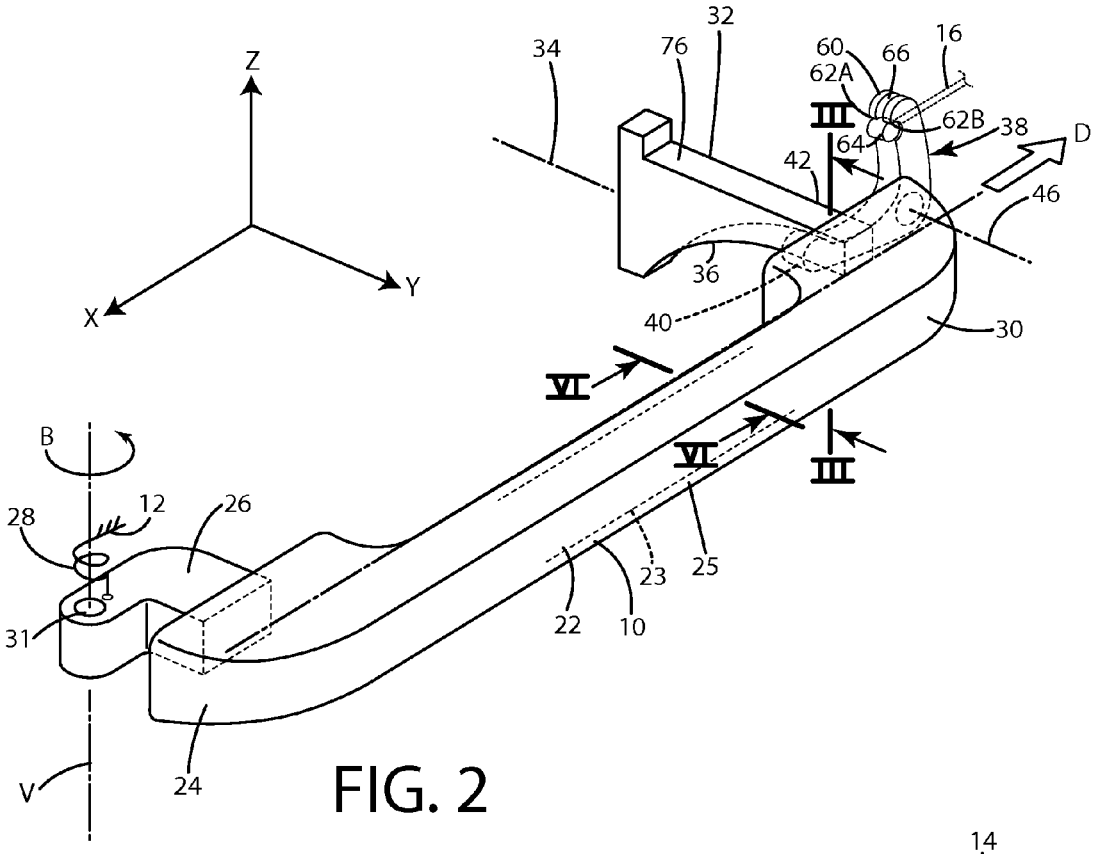
FIG. 2 is partially fragmentary isometric view of a door handle according to one aspect of the present invention.
Figure 9:
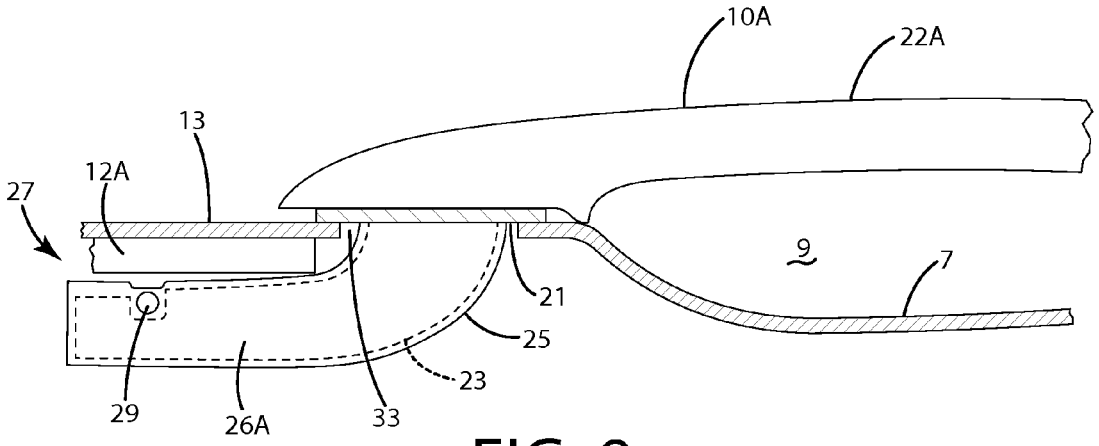
FIG. 9 is a partially fragmentary plan view of the handle.

With further reference to FIG. 2, handle 10 includes a handle body or strap 22 having a forward end 24 with a pivot hook 26 having pivot structure 31 (e.g. and opening or a pin) that rotatably mounts the strap 22 to the door structure 12 in a known manner for rotation about a generally vertical axis "V." Strap 22 may include an internal metal structure 23 and a polymer sleeve or cladding 25 that is formed from acetal (POM) or other suitable material. With further reference to FIG. 9, a handle 10A includes a handle strap 22A having a pivot hook 26A that may be constrained by a hinge structure 27 of a known design that includes a pivot pin 29 and a clevis or other suitable structure (not shown) that prevents vertical movement of strap 22. Pivot pin 29 may be integrally formed with polymer sleeve 25. Pin 29 is pivotably connected with an outer panel reinforcement structure 12A that is secured to outer skin 13 of door 2. Skin 13 forms a pocket 7 defining a space 9 between strap 22A and skin 13. A gasket 21 may be formed integrally with polymer sleeve 25 to provide a watertight seal around opening 33 in the outer skin 13 of door 2. It will be understood that handle straps 22 and 22A may be movably connected to door structure 12 utilizing various connecting structures, and the present invention is not limited to the specific arrangements described herein. A torsion spring 28 operably interconnects the handle 10 with the door structure 12, and biases the handle 10 towards a closed position as indicated by the arrow "B" about vertical axis V.

Rearward end 30 of handle strap 22 includes a rigid extension 32 that extends in a horizontal direction 34 that is generally parallel to the vehicle Y axis when the handle 10 is in a closed position as shown in FIG. 2. Extension 32 may be integrally formed with handle strap 22. For example, extension 32 may comprise a portion of internal metal structure 23, or it may be rigidly attached to internal structure 23.

Figure 6:
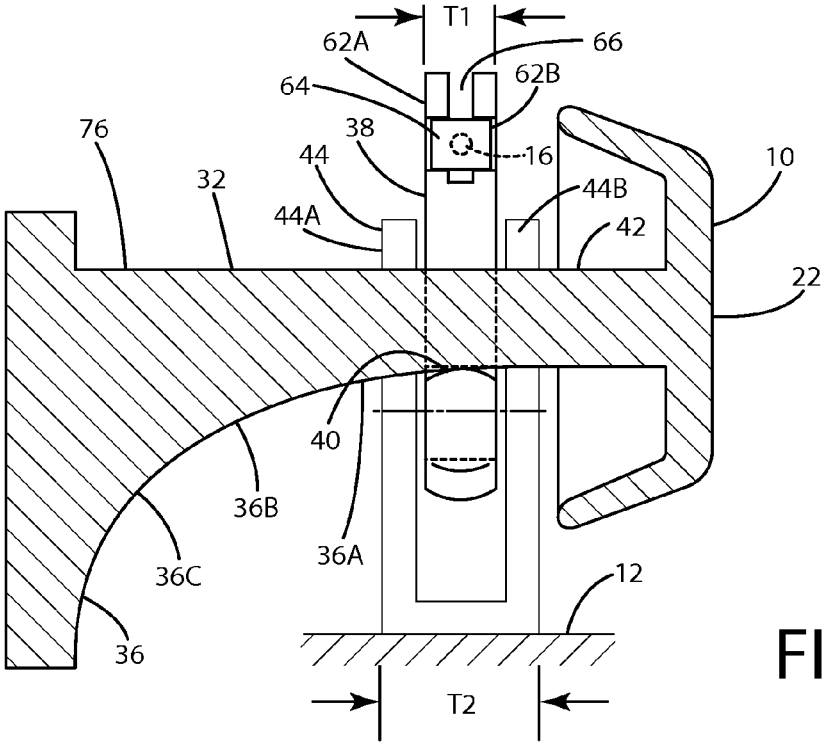
FIG. 6 is a cross sectional view of the handle of FIG. 2 taken along the line VI-VI showing the handle in a closed position.
Figure 7:
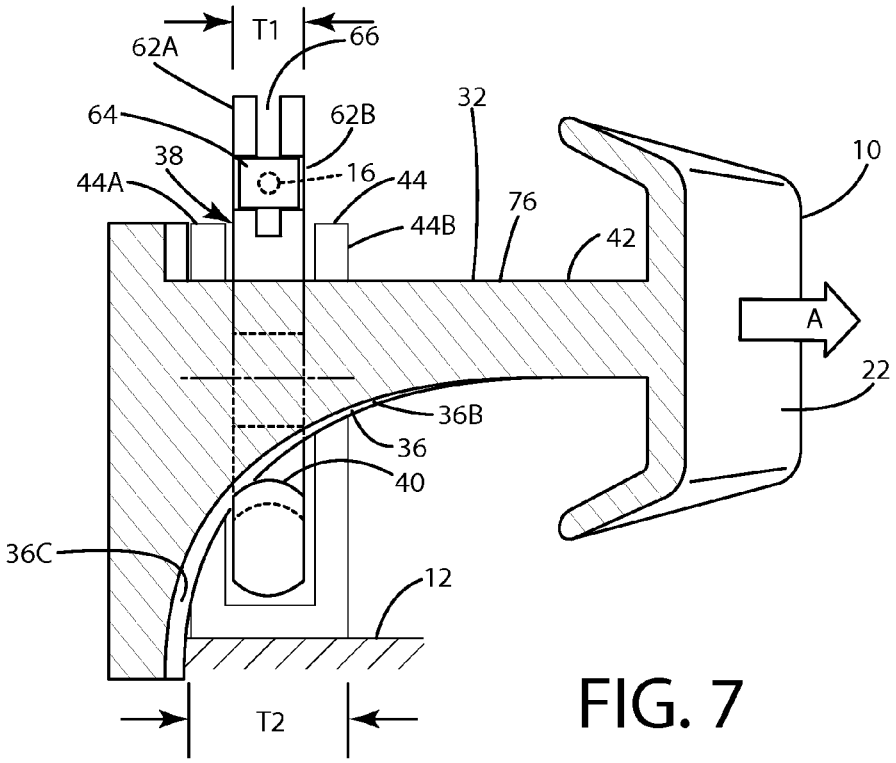
FIG. 7 shows the handle of FIG. 6 in an opened position.

The extension 32 includes a ramp surface 36 that slidably engages a follower surface 40 of a movable member such as a bellcrank 38 (see also FIG. 3). As discussed in more detail below, as handle 10 is moved outwardly, the follower surface 40 of bellcrank 38 slides along the ramp surface 36, thereby causing bellcrank 38 to move (e.g. rotate) and pull on cable 16 to thereby unlatch the latch mechanism 14. Bellcrank 38 is rotatably mounted to vehicle structure 12 by a bracket 44 (FIG. 3) or other suitable mounting arrangement for rotation about a horizontal axis 46 that is generally parallel to the Y axis of vehicle 1. With further reference to FIGS. 6 and 7, bracket 44 may comprise a generally U-shaped member having spaced-apart structures 44A and 44B that engage a pin 58 to thereby movably/rotatably mount bellcrank 38 to vehicle door structure 12. It will be understood that the bracket 44 may have virtually any configuration as may be required for a particular application.

Referring again to FIG. 3, a torsion spring 48 rotatably biases the bellcrank 38 about axis 46 in a direction of the arrow "C" to thereby bias follower surface 40 of bellcrank 38 into sliding contact with ramp surface 36 of extension 32 of handle 10. Bellcrank 38 may be substantially L-shaped, with a first leg 50 that is generally horizontal, a second leg 52 that is generally vertical, and a central portion 54 having an opening 56 that receives a pin 58 to pivotably mount the bellcrank 38 to bracket 44/door structure 12. The end 60 of second leg 52 of bellcrank 38 includes a pair of recesses 62A and 62B that receive/engage an end fitting 64 of cable 16, and cable 16 passes through a slot 66 in end 60 of second leg 52 of bellcrank 38. Latch mechanism 14 may optionally include a spring 68 (shown schematically in FIG. 3) of a known type that is operably connected to the end 16A of cable 16 to thereby bias the cable 16 in the direction of the arrow "D."

End 70 of first leg 50 of bellcrank 38 may be curved to form follower surface 40. As shown in FIGS. 6 and 7, the follower surface 40 may have a convex shape that is generally spherical. Also, the follower surface 40 may comprise a roller or the like. In the illustrated example, the first leg 50 generally extends in the X direction (i.e. in the forward direction) when door handle 10 is in a closed or rest position. However, the first leg 50 could also be configured to extend rearwardly, with axis 46 positioned in front of extension 32 of handle 10 (FIG. 2). Similarly, although second leg 52 of bellcrank 38 may extend upwardly as shown, second leg 52 could also extend downwardly. Still further, bellcrank 38 may comprise other shapes such as a generally elongated link with second leg 52 extending horizontally as shown by dashed lines 52A in FIG. 3. End 60A of horizontal second leg 52A may be connected to cable 16, such that end 60A moves upwardly to pull on cable 16. Still further, bellcrank 38 may comprise a pulley-type member whereby the cable 16 wraps around a cylindrical surface (not shown), that is rotated due to engagement of a follower surface 40 with ramp surface 36. In general, bellcrank 38 could be movably interconnected to door structure 12 utilizing a wide variety of structures, and bellcrank 38 is not necessarily limited to a pivoting connection.

Figure 4:
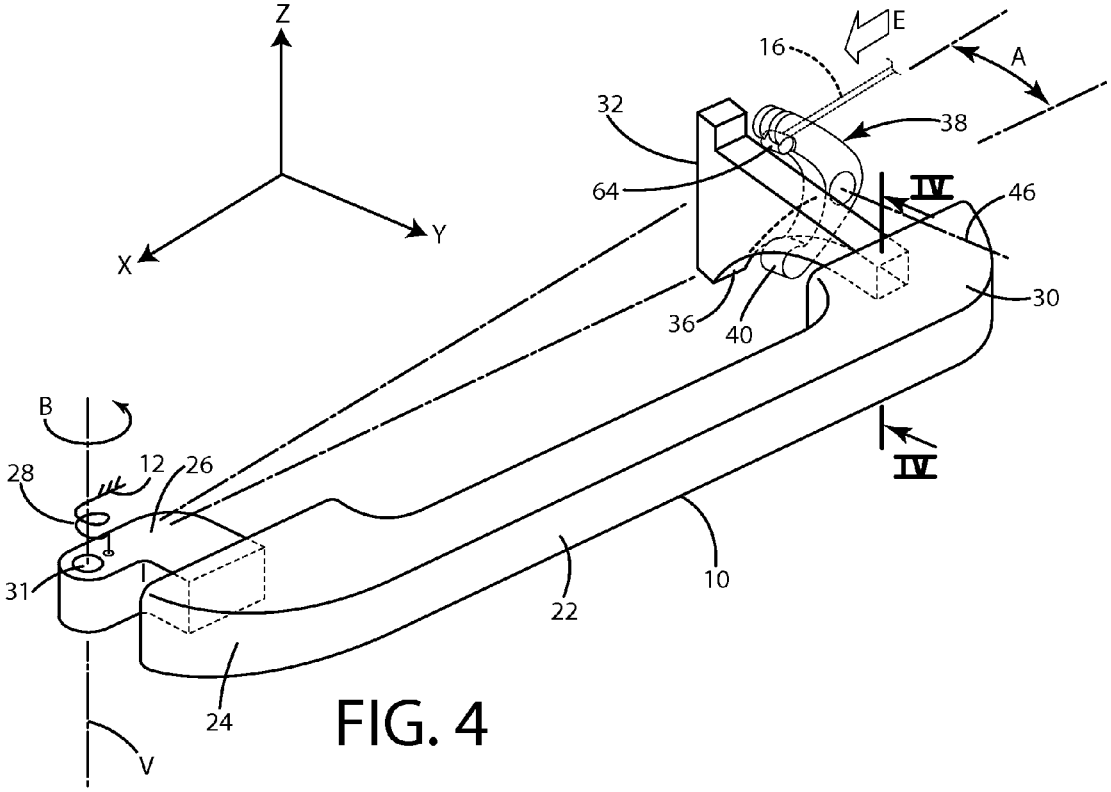
FIG. 4 is an isometric view of the door handle of FIG. 2 showing the handle being opened.
Figure 5:
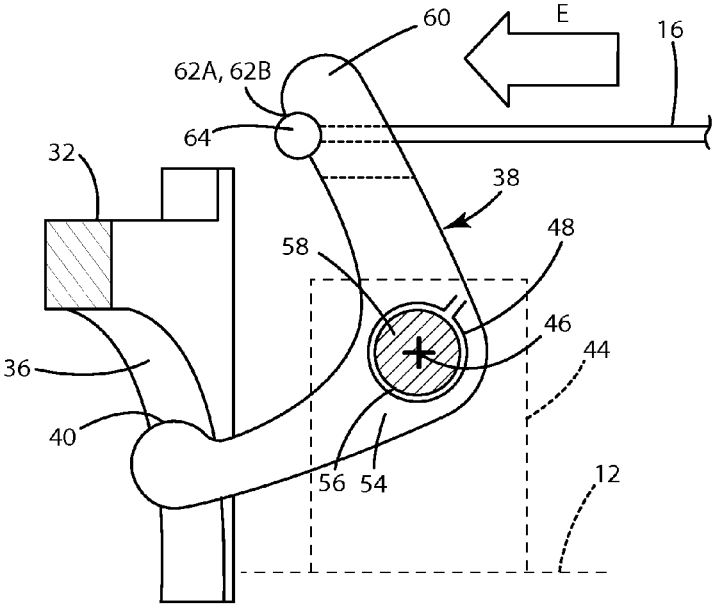
FIG. 5 is a cross sectional view of the handle of FIG. 4 taken along the line IV-IV.

With further reference to FIGS. 4-7, in use a user grasps the handle strap 22 and pulls outwardly, thereby shifting the rearward end 30 of strap 22 outwardly as shown by the arrow A (FIG. 4). This causes the strap 22 to rotate about vertical axis V (FIG. 4), and also shifts the extension 32 outwardly in an arc about the vertical axis V. Thus, the movement of extension 32 is horizontal, and generally parallel to the Y axis of the vehicle 1. As the extension 32 moves outwardly, follower surface 40 of bellcrank 38 slides along ramp surface 36, thereby rotating bellcrank 38 to shift cable 16 longitudinally in the direction of the arrow "E." When the strap 22 is in a closed position (FIG. 6), the follower surface 40 engages a downwardly facing first portion 36A of ramp surface 36 that is approximately horizontal. As the handle strap 22 moves from the closed position (FIG. 6) to the open position (FIG. 7), the follower surface 40 of bellcrank 38 slides along an intermediate portion 36B and an end portion 36C of ramp surface 36. In the illustrated example, the ramp surface 36 is concave. However, the ramp surface 36 may have a variety of different shapes, and could be substantially planar, or convex, as may be required for a particular application. Also, the ramp surface 36 could be configured to face upwardly, forwardly, or rearwardly, or at an angle in between, and the orientation of the bellcrank 38 may be varied as required.

Significantly, the bellcrank 38 may be configured to rotate about an axis 46 that is not vertical. Specifically, the axis 46 may be generally parallel to the Y axis of the vehicle, such that the bellcrank 38 is generally disposed in the plane of the door 2. The thickness "T1" (FIGS. 6 and 7) of bellcrank 38 may be relatively small (e.g. 0.050-0.100 inches), and the thickness "T2" of the bracket 44 may also be relatively small. This permits the bellcrank 38 to be mounted to the door structure 12 in a manner that requires very little space in the Y direction of the vehicle, thereby permitting a relatively thin construction for door 2 in the vicinity of the handle 10. Furthermore, additional internal door components such as door glass 3 (FIG. 1) and other components (not shown) may be positioned within the interior space of door 2 in the vicinity of the door handle 10.

Also, because the bellcrank 38 rotates about an axis 46 that is generally parallel to the vehicle Y axis, a side impact will result in inertia in the Y-direction that is parallel to the axis of rotation 46 of bellcrank 38. Thus, bellcrank 38 does not tend to rotate as a result of a side impact. Nevertheless, handle strap 22 may tend to rotate outwardly as a result of side impacts. Thus, to prevent inadvertent unlatching of latch mechanism 14, speed-based lock mechanism 8 (FIG. 1) may be operably connected to the cable 16. The speed-based lock mechanism 8 may comprise a mechanism as described in detail in co-pending U.S. Pat. No. 9,604,450 entitled "VEHICLE DOOR CLOSURE SYSTEM INCLUDING SPEED-BASED LATCH RELEASE," issued on Mar. 28, 2017, the entire contents of which are incorporated by reference. In general, speed-based lock 8 may comprise virtually any mechanism of the type that prevent rapid movement of cable 16 to thereby prevent inadvertent unlatching of latch mechanism 14 in the event door handle strap 22 is moved outwardly at a high velocity.

Figure 8:
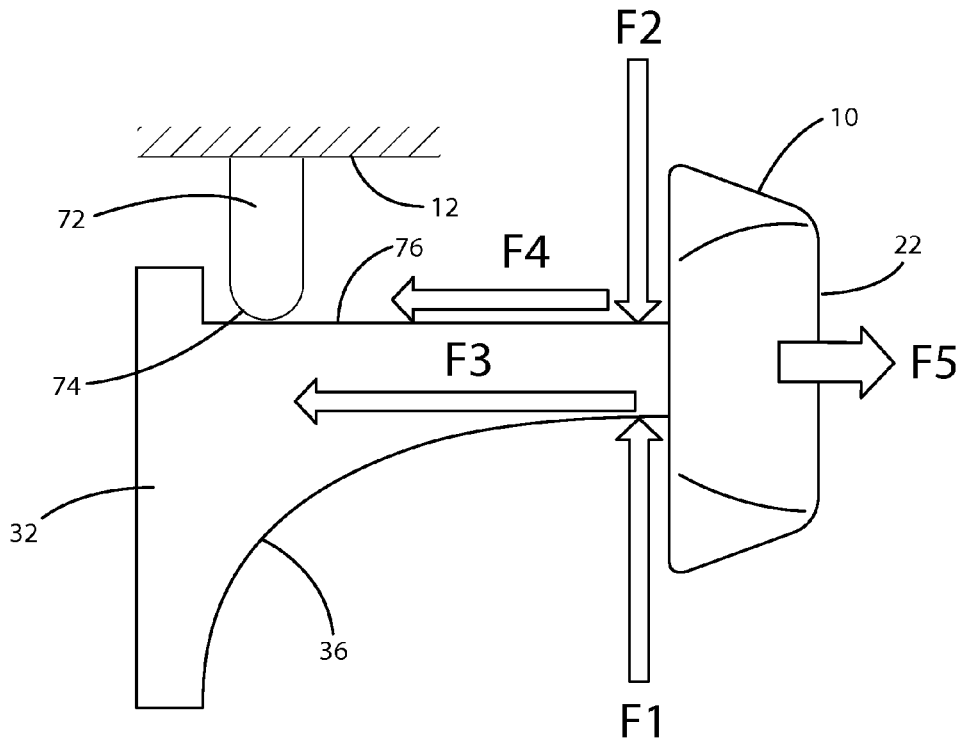
FIG. 8 is a partially schematic view showing the forces acting on the handle.

With further reference to FIG. 8, in use, a user pulls outwardly on handle strap 22 with a release force F5. Follower surface 40 of bellcrank 38 generates an upward force "F1" acting on ramp surface 36 that is equal to a downward force "F2" due to the connection of handle strap 22 to the door structure 12. For example, the door structure 12 may include a structure 72 having a slide surface 74 that slidably engages upper surface 76 of extension 32 to restrain handle strap 22. Also, hook 26 (FIG. 2) of handle 10 may also be vertically restrained by washers (not shown) or other slidable structures to prevent vertical movement of handle strap 22. The restraining forces F2 are equal to force F1.

As the handle strap 22 moves outwardly, a force "F3" acting on handle strap 22 is generated due to friction of follower surface 40 on ramp surface 36. The force F3 is equal to the coefficient of friction (μ) of the ramp surface 36 and follower surface 40 multiplied times the bellcrank force F1. A force "F4" acting against the outward force F5 is also generated due to friction between slide surface 74 and upper surface 76 and/or frictional engagement of hook 26 (FIG. 4) with the door structure 12. The force F4 is equal to the coefficient of friction (μ) between slide surface 74 and upper surface 76 of extension 32.

The force F5 applied a user is equal to F3+F4. Thus, the force F5 is equal to:

$$F5=\mu(F1+F4) \tag{1.0}$$

Thus, the release force F5 on the handle strap 22 is a function of the frictional forces, not the force on cable 16. In general, the force F5 required to open the door handle 10 may be very low. For example, if bellcrank 38 has a 1:1 ratio, and latch mechanism 14 requires a latch release force (tension on cable 16) of 50 N, and if follower surface 40 and ramp surface 36 define a high coefficient of friction of 0.3, the handle assembly 10 provides a relatively low release effort F5 of 30 N:

$$F5=F3+F4=\mu(F1+F2)=0.3(50+50)=30N \tag{2.0}$$

If low friction materials are utilized at the interface between ramp surface 36 and follower surface 40, a very low force F5 is required to unlatch the latch mechanism 14. Specifically, if a coefficient of friction of 0.1 is utilized, even a high latch release effort of 50 N would only require a 10 N release force F5 (see equation 1.0).

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle door comprising:

a door structure having upright inner and outer sides, the door structure defining a generally horizontal axis that is transverse to the upright inner and outer sides;

an exterior handle movably mounted to the door structure for movement between a rest position and an opened position, the exterior handle including a handle strap and a rigid extension attached to the handle strap, the rigid extension defining an upper flat surface and a lower inclined ramp surface that extends from the handle strap toward an opposed end of the rigid extension such that the inclined ramp surface moves relative to the handle strap;

a bellcrank rotatably connected to the door structure for rotation about the generally horizontal axis, the bellcrank including a follower that engages the inclined ramp surface such that movement of the exterior handle from the rest position to the opened position causes the bellcrank to rotate about the generally horizontal axis;

a latch mechanism configured to selectively retain the door in a dosed position when latched; and linkage operably interconnecting the bellcrank and the latch mechanism such that rotation of the bellcrank unlatches the latch mechanism.

2. The vehicle door of claim 1, wherein:

the exterior handle pivots about a generally vertical axis when moving from the rest position to the opened position.

3. The vehicle door of claim 2, wherein:

the inclined ramp surface extends inwardly from the exterior handle.

4. The vehicle door of claim 3, wherein:

the handle defines a forward end that is pivotably connected to the door structure, and a rearward end that moves outwardly as the handle moves from the rest position to the opened position; and wherein:

the handle extension extends inwardly from the rearward end of the handle.

5. The vehicle door of claim 4, wherein:

at least a portion of the inclined ramp surface has a concave curvature, and wherein at least a portion of the inclined ramp surface faces downwardly and outwardly.

6. The vehicle door of claim 5, wherein:

the bellcrank includes a first end forming the follower.

7. The vehicle door of claim 6, wherein:

the bellcrank includes a second end that is connected to the linkage.

8. The vehicle door of claim 7, including:

a first resilient member rotatably biasing the bellcrank such that the follower remains in sliding contact with the included ramp surface as the handle moves from the rest position to the opened position; and a second resilient member rotatably biasing the handle towards the rest position.

9. The vehicle door of claim 8, wherein:

the linkage comprises an elongated flexible cable;

the bellcrank is generally L-shaped with a generally horizontal first leg having an upwardly facing end surface defining the follower, and an upwardly extending second leg having an upper end that is connected to the elongated flexible cable.

10. The vehicle door of claim 9, wherein:

the first and second legs extend from a central portion of the bellcrank that is rotatably connected to the door structure;

the upper end of the second leg moves forwardly as the handle is rotated from the rest position to the opened position.

11. A vehicle door comprising:

a door structure defining an outside side and an inside side and a generally horizontal axis that is transverse to the outside side and the inside side;

a latch mechanism;

a handle pivotably connected to the door structure, the handle including a handle strap and a rigid extension attached to the handle strap, the rigid extension defining an upper flat surface and a lower inclined ramp surface that extends from the handle strap toward an opposed end of the rigid extension such that the inclined ramp surface moves relative to the handle strap;

a bell crank having a rounded follower surface;

a cable interconnecting the latch mechanism and the bellcrank; and wherein:

the rounded follower surface of the bellcrank slidably engage the ramp surface and rotates the bellcrank about the horizontal axis and pulls the cable to unlatch the latch mechanism as the handle pivots open.

12. The vehicle door of claim 11, wherein:

the ramp surface faces outwardly and downwardly.

13. The vehicle door of claim 12, wherein:

the bellcrank includes a generally horizontal first leg having an inwardly facing follower surface on an end thereof slidably engaging the ramp surface such that the end moves downwardly as the handle is opened.

14. The vehicle door of claim 13, wherein:

the bellcrank is generally L-shaped and includes a generally upright second leg that is connected to the cable and pulls the cable upon rotation of the bellcrank.

15. The vehicle door of claim 14, wherein:

the handle includes a forward end that is pivotably connected to the door structure for rotation about a generally vertical axis.

16. The vehicle door of claim 15, wherein:

the handle includes a rearward end and an extension that extends inwardly from the rearward end, and wherein the ramp surface is defined on a lower side of the extension.

* * * * *